US005613530A

United States Patent [19]

Kincel et al.

[11] Patent Number: 5,613,530

[45] Date of Patent: Mar. 25, 1997

[54] HAND HELD TWIST TIE APPARATUS

[75] Inventors: Roger S. Kincel, Carlsbad; Luis C. Contreras, Placentia, both of Calif.

[73] Assignee: Johnston International Corp., Santa Ana, Calif.

[21] Appl. No.: 501,365

[22] Filed: Jul. 12, 1995

[51] Int. Cl.[6] ..... B21F 15/04

[52] U.S. Cl. ..... 140/119; 140/57; 140/93 A

[58] Field of Search ..... 140/57, 93 A, 140/115, 119

[56] References Cited

U.S. PATENT DOCUMENTS

| | | | |
|---|---|---|---|
| 3,369,573 | 2/1968 | Baker et al. | 140/119 |
| 3,590,885 | 7/1971 | Ward . | |
| 3,821,058 | 6/1974 | Miller . | |
| 3,970,117 | 7/1976 | Zamansky et al. . | |
| 4,054,160 | 10/1977 | Knudsen | 140/93 A |
| 4,362,192 | 12/1982 | Furlong et al. . | |
| 4,865,087 | 9/1989 | Geiger | 140/119 |
| 4,953,598 | 9/1990 | McCavey . | |
| 5,217,049 | 6/1993 | Forsyth . | |

*Primary Examiner*—Lowell A. Larson
*Attorney, Agent, or Firm*—Gordon K. Anderson

[57] ABSTRACT

A hand held portable twist tie apparatus which has a frame (20), a drive motor (44) and controls. A set of reduction drive gears (68) reduce the motor speed and drive a gear cluster with turntable (74). A twister (94) is rotated by a drive train (114) that intermeshes at the proper time with the gear cluster. A spring loaded shuttling carriage (126) slides along the twister and contains arms (130) that swing around the product and guide twist tie material (76) to enclose the product to be tied. A feed transport arm (142) advances the tie material and cuts it to the appropriate length for complete encircling, tightening and twisting by the above elements. A housing (208) and shield (210) cover the moving parts and a reel holder (194) mounted on top of the housing accepts a roll of tie material to supply the apparatus. A handle (218) provides a grip for one handed operation and power is supplied by a battery (48), or power converter (58).

17 Claims, 6 Drawing Sheets

HAND HELD TWIST TIE APPARATUS

TECHNICAL FIELD

The present invention relates to automatic twist tie material tools in general. More specifically to a new hand operated twist tie device powered by an electric motor with remote batteries or an A.C./D.C. converter. The self-acting tool is small enough to be portable and manually transferred to engage a bag or container for sealing with twist tie material.

BACKGROUND ART

Previously, many types of wire tying tools have been used in endeavoring to provide an effective means for producing an automatic or semi-automatic twist tie of a wire. Prior art is replete with devices that twist tie structural wire for use with joints in concrete reinforcing bar. Others have developed tools for other purposes, such as bag ties and double loop bar ties for binding sacks and bundling elongated items utilizing pre-looped wire. Still others have directed their attention to tying cable harnesses with thermoplastic, resin coated lacing tape.

Concrete reinforcing bar tying tools have been in use utilizing either a pneumatic or an electric energy source. Some use an electric drill motor, and others employ integral motors and electromagnetic solenoids. In most cases, the tool employs jaws that surround the joint and a wire is automatically, or manually, threaded through the jaws to develop the tying sequence.

While the operation of looping, cutting, and twisting wires is all basically similar, those advanced specifically for reinforcement bar must be large and robust, as the wire attachment must have sufficient strength to insure that the reinforcing bars are not displaced while pouring heavy fluid concrete directly over the joint. Dedicated motors and solenoids have also been used in conjunction with lever arms and gears to provide the needed strength and stoutness for this application and, as such, are large and powerful.

A search of the prior art did not disclose any patents that read directly on the claims of the instant invention, however, the following U.S. patents are considered related:

| U.S. Pat. No. | Inventor | Issue Date |
|---|---|---|
| 5,217,049 | Forsyth | Jun. 8, 1993 |
| 4,953,598 | McCavey | Sep. 4, 1990 |
| 4,362,192 | Furlong et al | Dec. 7, 1982 |
| 3,970,117 | Zamansky et al | Jul. 20, 1976 |
| 3,821,058 | Miller | Jun. 25, 1974 |
| 3,590,885 | Ward | Jul. 6, 1971 |

Forsyth, in U.S. Pat. No. 5,217,049, teaches a portable, hand operated power tool that automatically ties intersecting rebar. The device employs an electric drill motor as the rotating power source. The drill motor selectively engages a housed transmission and jaw assembly that encircles the work piece. Wire is stored on a belt mounted reel and fed around guide channels integral with the jaws. Electromagnets control retractable levers preventing rotation, however, when withdrawn the drill motors motion rotates the device to produce a twist tie of the wire.

U.S. Pat. No. 4,953,598 of McCavey discloses a hand held power tool also for rebar connection. The tool includes a body that houses the operating components and provides a wire reel holder, handle with trigger and support for the wire channel guide that momentarily surrounds the rebar joint. The rebar tying wire is fed through the housing with rollers to a circular turret, including two side-by-side clamping jaws which hold one end of the wire. The feed wheels reverse, thereby removing the slack from the wire and tighten the rebar joint. The other end of the wire is clamped and cut, then the entire turret, including the attaching jaws, is rotated to twist the wire ends together after the channel guide is rotated from the joint. Three motors and four electromagnetic solenoids are used to provide the torque and linear force for the device.

Furlong et al U.S. Pat. No. 4,362,192 again, is directed to rebar tying. A fixed and .a movable jaw is Clamped around the rebar joint and a predetermined length of wire is fed into guiding grooves within the jaws forming a loop. The end of the wire is cut to length by a cutter bar on a rotatable mandrel having opposed radial flange sections. Relative rotation of the inner mandrel to an outer mandrel performs the wire cutting and twisting. Controls provide proper positioning of the openings for passage of wire upon each operational cycle. An electric motor and gear reduction arrangement, with a clutch and brake, provide the rotational torque and a series of solenoids open and close the jaws and provide timing sequence functions of rotation.

U.S. Pat. No. 3,970,117 issued to Zamansky et al presents a twister for wire ties that incorporate loops on both ends of a short length of wire. The wire ties are manually placed around the object to be fastened and a hook is inserted into both wire loops. When the handle of the twister is manually pulled away from the wire, the integral D.C. motor is engaged rotating the hook and completing the twisting procedure. When pulling force is released, the motor is disengaged by spring pressure.

Millers U.S. Pat. No. 3,821,058 is directed to fastening a length of thermoplastic, resin coated harness cable lacing tape around a cable bundle by twisting, fusing, and cutting the tape. The hand held tool contains a motor which rotates a tubular drive shaft with a twisting end. The heating and severing function is contained within the jaws retracted into a tool barrel. Lacing tape is supplied through a shaft and is manually looped around the cable bundle with the free end attached to the twisting member. The drive shaft is rotated, which twists the tape and simultaneously the jaws are extended which sever and fuse the tape.

U.S. Pat. No. 3,590,885 of Ward teaches a hand tool for tying rebars with a twist that avoids bunching or piling of the convolutions of the tie on top of one another. Spring loaded plates, that are shiftable, are located on one end of the tool body, which are rearranged by the ends of the wire loop during the twisting operation, such that the entire body moves away from the work piece. The power is provided by pneumatic air pressure.

It may be seen that the prior art incorporates large, heavy mechanisms that employ pneumatic power or electrical drives requiring numerous separate motors, clutches, brakes, and electromagnetic solenoids, etc., to accomplish the task at hand.

DISCLOSURE OF THE INVENTION

While the use of twist tie machines for sealing a bag or container is not new, and portable devices have been developed for much heavier, rugged wire tying in the field of concrete reinforcing bar, there has been a need for a portable lightweight electrically operated device small enough to be easily carried to the product to be sealed, in the field of twist tie material. Previously, wire and paper, or plastic twist tie material has been automatically tied and cut by large stationary equipment that required bringing the product directly to the machine, or pneumatic portable equipment requiring awkward hose attachment. While the tying process has been satisfactory, the operation required special procedures employing conveyer lines, and the like, to complete the sealing task at hand.

It is, therefore, a primary object of the invention to provide a twist tie apparatus small enough to be carried and operated by one hand, leaving the other hand free to hold or orient the product being tied. This novel device contains a reel on the top for storing the wire tie material and a handle or grip with an electrical trigger switch underneath for ease of manipulation. Power to operate this automatic device is provided optionally by a 9.6 volt or nominal 12 volt D.C. battery carried in a holder attached to a belt around the operators waist, or a 115 volt A.C. to 9.6/12 volt D.C. power converter plugged into city power. In either case, the device is compact and light enough to be easily carried and operated by one hand. If the battery is used, it is conveniently carried by the operator about the waist and easily recharged using conventional methods. The battery embodiment preferably utilizes a battery compatible with cordless drills and screwdrivers which are readily replaceable and well known in the art. When the application dictates a conventional AC/DC power converter supplies continual power through a small, flexible, portable cord.

An important object of the invention is directed to the safety feature of not requiring mechanical jaws to close around the work piece, to direct the twist tie material thereabout. Instead of closing mechanical jaws, a cam plate with an open throat remains stationary and encompass the object to be fastened. A separate shuttle moves forward separating a pair of arms around the product and directing the twist tie material across the space between the movable arms jumping or bridging the gap, so to speak. This means that only the light, pliable twist tie material itself crosses the open throat completely unsupported, therefore, if the operators hand or fingers inadvertently are placed within the aperture, only the flexible wire will be in contact with a body part. Further, if the device is placed over ones finger far enough to clear the threading arms and both the "product present" switch and the trigger switch were inadvertently energized at the same time, the finger would be pulled inward by the twist tie material and would then be harmlessly tied with the material in the same manner as a plastic bag. Prior art, particularly in the robust, heavy wire tying equipment for rebar could crush, cut or even sever the operators fingers if improperly used or a control malfunction were to occur. If the arms are prevented from completing their normal travel, an interlock prevents the tie material from being fed, which could cause a tangle with the next operational sequence.

Another object of the invention is the clearing mechanism for untangling the twist tie material in the event a malfunction takes place and the tie material becomes fouled. In this event, subsequent operation could wind the twist tie material into a hopeless mass. In stationary equipment the safety housing must be removed by a repairman to uncover the twisting apparatus. The instant invention circumvents this problem by incorporating an unsheathed spring loaded shaft that, by depressing, pushes the twister head outwardly away from the cam plate while the cam plate shield is pivoted upwardly exposing twister head for easy clearing of the tangle before it becomes critically severe. Further, the twist tie material reel is mounted on top of the device in full view and the material is directed around an open turn around roller, therefore, any feeding problem of the reel may be easily observed and corrected. The tie feed arm assembly is simple and the twist tie material is fed through a reliable combined knurled roller and elastomeric idler roller making a simple feed path easily understood by the operator. It may be seen that the simplicity of the device and access features preclude costly service calls or the necessity of sending the equipment out for repair.

Twist tie equipment is normally produced to accommodate a specific bundle diameter, obviously requiring different configurations of equipment to achieve that purpose. In the past, particularly in stationary devices, in order to produce a given diameter of wrap the length of the tie material or even the opening between the jaws change, as a result, separate components are necessary. It is, therefore, a further object of the invention for the apparatus to accommodate three basic product sizes using only a single set of parts. The apparatus may be adapted the nominal 3/8, 3/4 or 1.00 inch (0.95, 1.90 or 2.54 cm) diameter by a simple component positioning using multiple attaching holes and minor parts change. Not only does this feature simplify manufacture and improve cost efficiency, but the device may be returned to the factory at a later date and at nominal expense be easily reworked to a different size. It should be noted that the plus or minus tolerance of the above mentioned nominal diameter adaption overlap to provide full coverage from zero to 1.00 inch (2.54 cm).

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
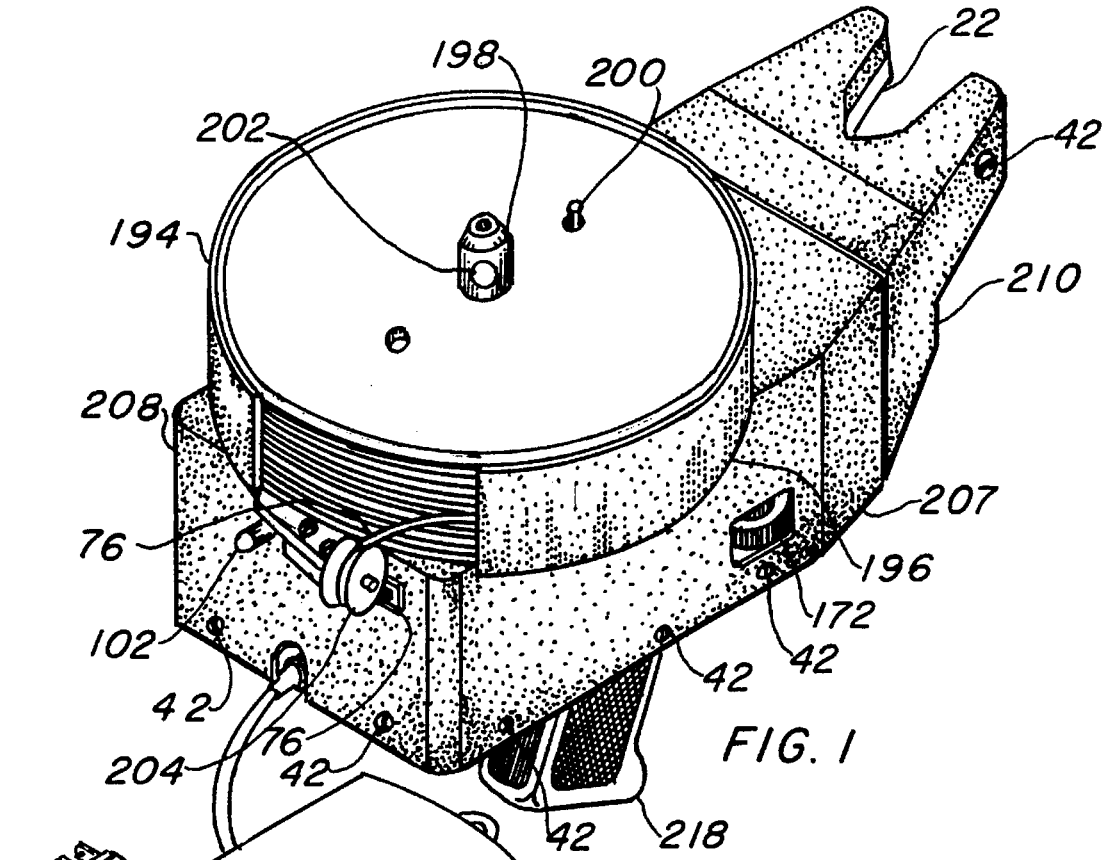
FIG. 1 is a partial isometric view of the preferred embodiment with the power supplied by the power converter embodiment.
Figure 2:
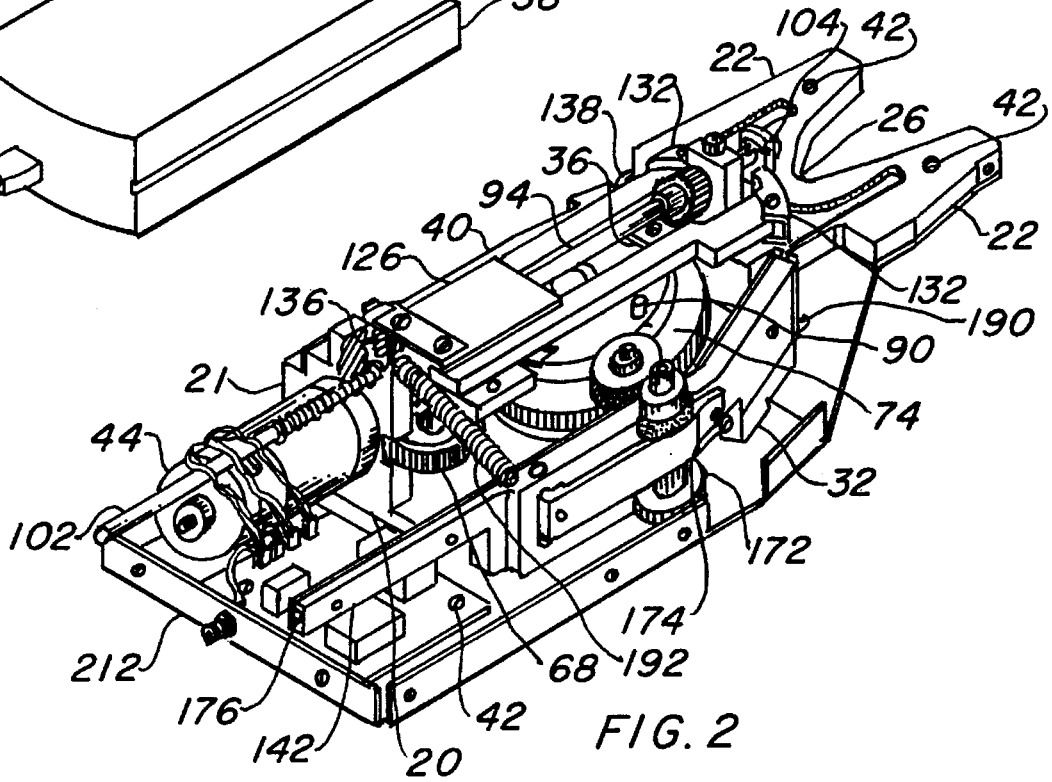
FIG. 2 is a partial isometric view of the preferred embodiment with the power source, enclosure and housing completely removed from the invention for clarity.

The best mode for carrying out the invention is presented in terms of a preferred embodiment. The preferred embodiment, as shown in FIGS. 1 through 18 is comprised of electromechanical drive means including a mounting frame 20, as shown in FIG. 2, and by itself in FIG. 3. The frame 20 consists of a structural base 21 that is preferably fabricated of metal or structural thermoplastic. The frame 20 has an outwardly extending cam plate 22 attached or integral therewith. The cam plate 22 contains opposed recessed grooves 24 therein and is shaped to form a product receiving throat 26 on the outward end. The frame 20 further includes a reduction gear post 28, a cluster gear post 30, a pivot block arm 32, a roller switch mounting plate 34, a capstan latch plate 36, and a carriage latch shaft 38 to which a spring loaded carriage latch 40 is pivotally mounted and held in place with a retaining ring, split washer, hairpin clip, or the like. All of the above elements are attached with threaded fasteners 42, or the like.

Figure 4:
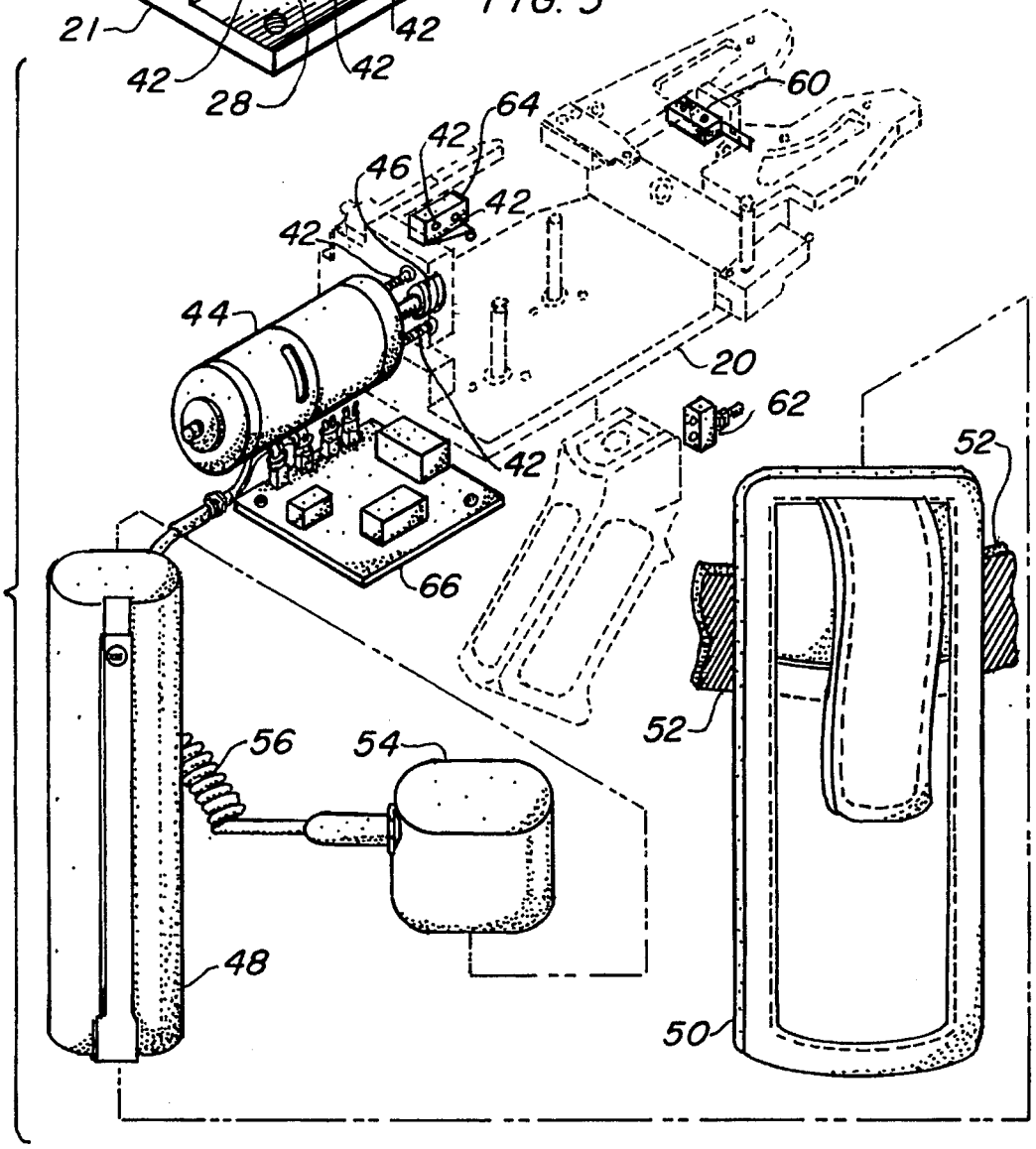
FIG. 4 is an exploded partial isometric view of the electric drive motor and control means with the frame and handle shown in dashed lines to illustrate the physical orientation thereof. The battery embodiment is illustrated for the power source to operate the apparatus.

An electric drive motor 44, including a shaft gear 46, is attached to the frame with threaded fasteners 42, for supplying electromotive force to operate the apparatus. This motor 44 is illustrated in FIGS. 2 and 4 and is preferably the direct current permanent magnet brushed type. It has been found that a 13,000 RPM speed and 9.6 volt motor is appropriate, however, other speeds and voltage characteristics will work equally well for the application, with 9 volts to 14 volts optimum. Even an alternating current or a pneumatic motor is an acceptable alternative.

Figure 18:
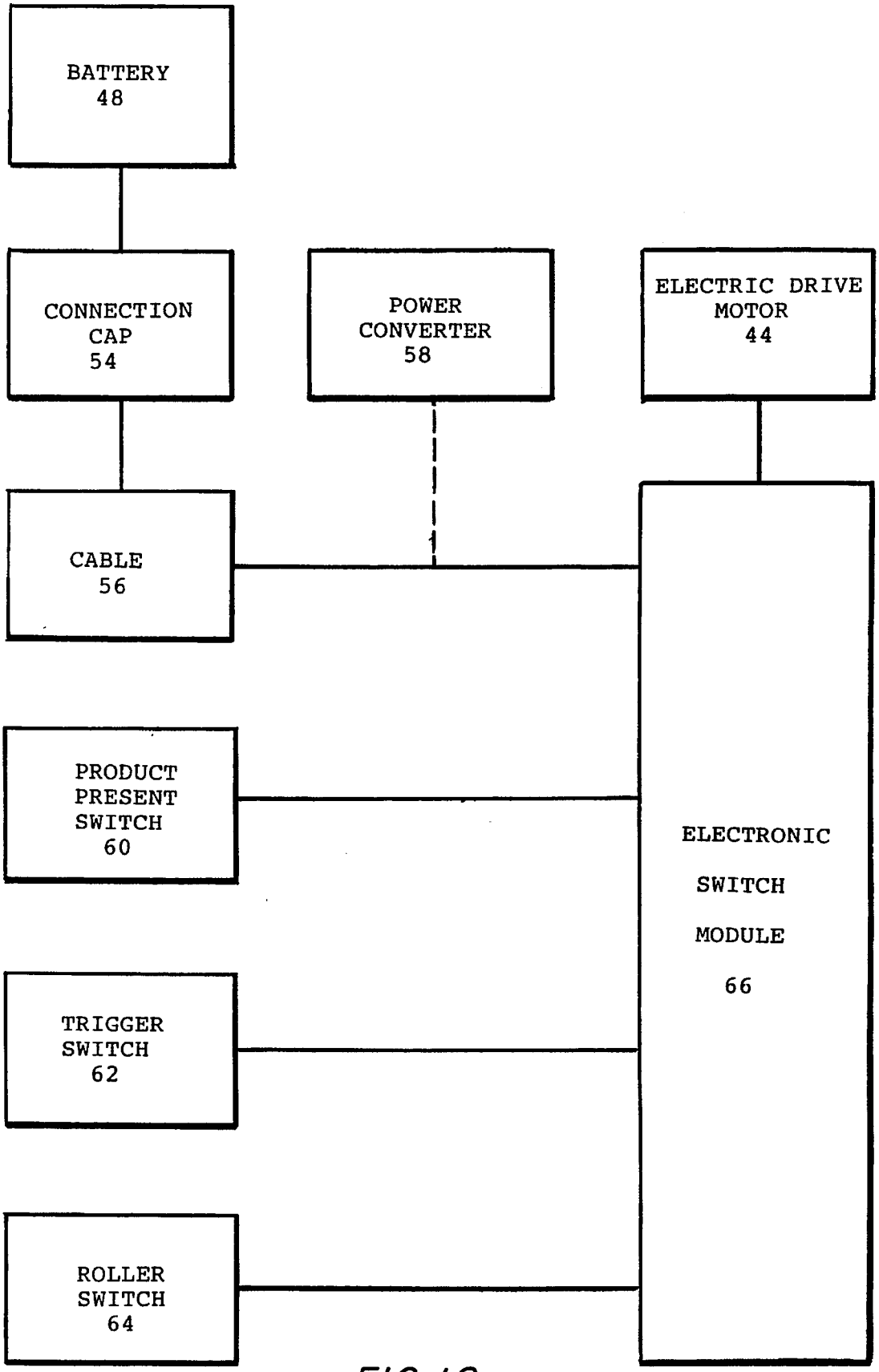
FIG. 18 is a block diagram of the motor control means.

Motor control means provide electric power to the motor 44, as well as circuits to start and stop the motor at the precise time. FIG. 18 illustrates, in a block diagram, the control functional relationship, and FIG. 4 illustrates the physical orientation of the system. In the battery embodiment, a remote, nominal 12 volt D.C. battery 48 of any type may be used, however, a 9.6 volt rechargeable nickel-cadmium is preferred. The battery 48 is stored in a holder 50 that is attached to a belt 52 for convenience to the operator to wear around the waist. It will be noted that the battery 48 may also be housed within the enclosure itself with equal ease and only size and weight of the apparatus is adversely effected. A connection cap 54 with an integral cable 56 fits over the battery 48 to transmit power to the motor. The cable 56 may be any appropriate size and type, with the coiled type, as illustrated in FIG. 4, preferred. An alternate embodiment for the battery 48, as the power source is an alternating current power to direct current power converter 58 with cable, as shown in FIG. 1. This converter 58 is well known in the art and plugs into standard household power for conversion to nominal 12 volt D.C. or 9.6 volt D.C.

A product present switch 60, having an extended lever, is located beneath the cam plate's product receiving throat 26 for sensing the presence of the product being tied by the apparatus. A plunger type, push button trigger switch 62 is located in the handle under the enclosure, explained in detail later. This trigger switch 62 and the product present switch 60 are electrically connected in series such that both switches must be energized to start the sequence of operation, as a safety measure.

A roller switch 64 is attached to the roller switch mounting plate 34 with threaded fasteners 42, as illustrated in FIG. 4. The roller switch 64 interfaces with a trip on the gear cluster, explained in detail later, to deenergize power to the motor 44. An electronic switch module 66 is utilized that essentially consists of a printed circuit board that incorporates an electromagnetic latching relay, and semi-conductors, embodying capacitors, resistors, arc suppressors, etc., to start the motor 44 and hold it electrically energized for one complete revolution of the gear cluster. All of the above switches and the power source feed into the electronic switch module 66, as shown in FIG. 4, to accomplish this operational function. It will be noted that the switches are preferably the miniature snap acting type, however, any type electrical switch or contact arrangement, or even photo-interrupt switches will function equally well.

Reduction drive gears 68 are revolvably affixed to the frame's reduction gear post 28 and are rotatably driven by the drive motor 44 through the motor shaft gear 46 for decreasing the motor output speed. The reduction drive gears 68 are illustrated assembled in FIG. 2 and completely removed from the invention in FIG. 5. The drive gears 68 consist of a motor worm gear 70 joined unitedly with a cluster spur gear 72.

A gear cluster with turntable 74 is revolvably affixed to the cluster gear post 30 rigidly mounted through the base 21. The gear cluster 74 is driven by the drive gears 68 and provide rotational energy or torque for twisting, encircling, tightening, feeding, measuring, and cutting twist tie material 76. The gear cluster with turntable 74 is illustrated assembled in FIG. 2 and completely removed from the invention in the exploded view of FIG. 6. A feed transport arm cam 78 is positioned on the bottom of the gear cluster and has an integral lobe that moves the arm into communication with the gear cluster.

Directly above the feed transport arm cam 78 is a drive spur gear 80 that is driven by the reduction drive gears 68 and provides the force to advance the tie material 76 during functional operation. A roller switch trip 82 is fastened to a top surface of the drive spur gear 80 to trip the roller switch 64 when the spur gear 80 rotates to a given position deenergizing the motor 44 when one complete revolution of the cluster has taken place. A bevel gear segment 84 is also mounted on top of the drive spur gear 80 adjacent to the switch trip 82 to rotate a twister drive at the appropriate sequence in the gear cluster's rotation.

A flanged standoff cartridge 86 is juxtapositioned on the bevel gear segment 84 and attached with threaded fasteners 42 for spacing the cluster relative to its activation function. The gear cluster with turntable 74 is completed by the attachment of a turntable 88 to an upper flange of the standoff cartridge 86 with threaded fasteners 42. An upstanding pin 90 protrudes upwardly from the top surface of the turntable 88 tripping the carriage latch 40 when it rotates, thereby striking the underside of the latch 40 releasing a spring loaded carriage. The pin 90 also resets the same carriage as it continues to rotate returning the carriage to its spring loaded position on each rotation of the turntable 88. The turntable 88 further contains a cam cut-out 92 on the peripheral top surface that interfaces with the capstan latch plate 36 dropping it down to interface with a capstan at the appropriate operational sequence.

Figures 5, 6, 7, 8:
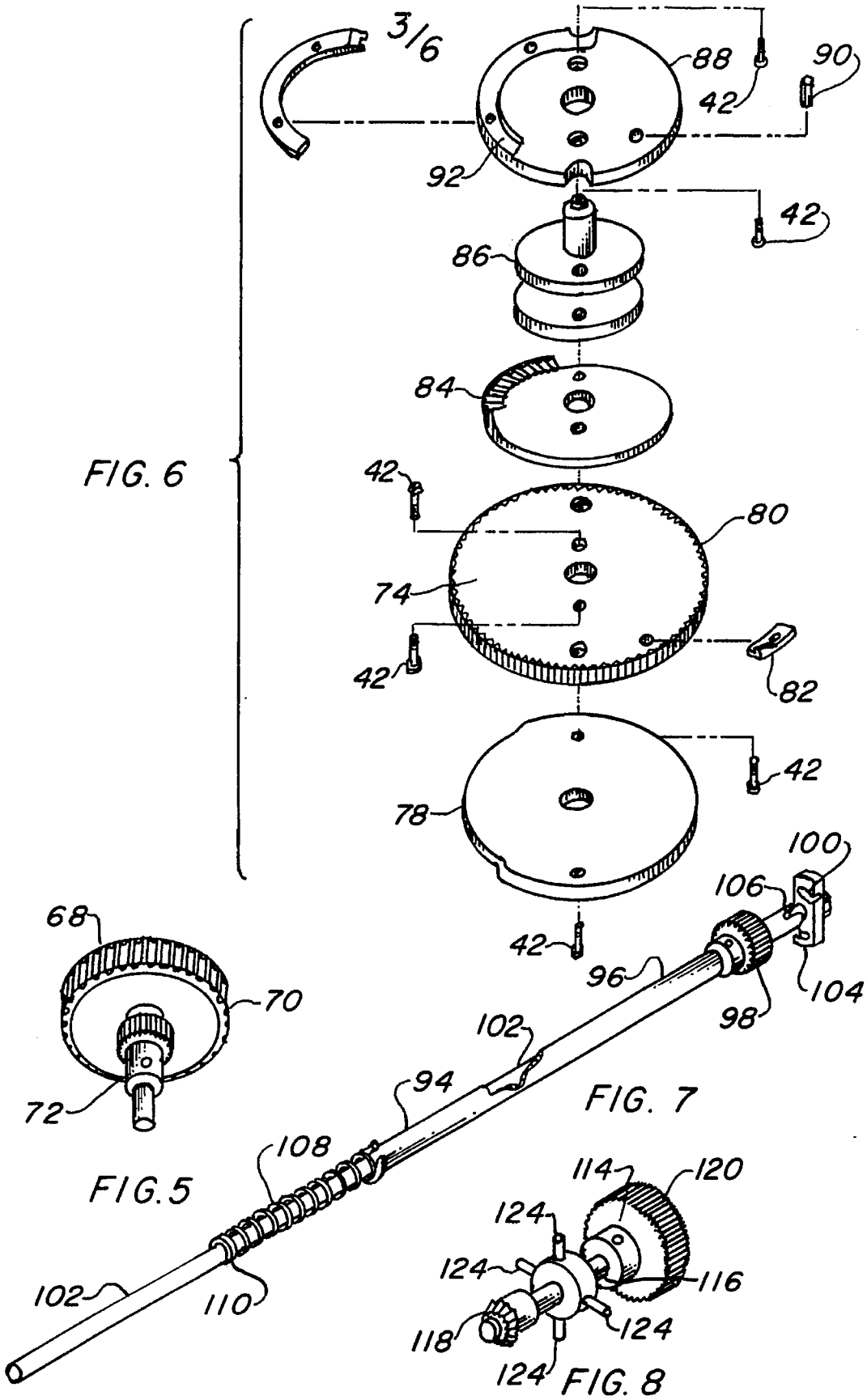
FIG. 5 is a partial isometric view of the reduction drive gears completely removed from the invention for clarity.
FIG. 6 is an exploded view of the gear cluster and turntable completely removed from the invention for clarity.
FIG. 7 is a partial isometric view of the twister completely removed from the invention for clarity.
FIG. 8 is a partial isometric view of the twister drive train completely removed from the invention for clarity.

FIG. 7 illustrates twisting means in the form of a twister 94 for twisting the tie material 76 into a tight joint. The twister 94 includes a hollow shaft 96 that is rotatably mounted into the frame 20, as shown in FIG. 2. The hollow shaft 96 also includes a shaft gear 98 installed thereon near the cam plate end and, at the apex of the same end, the shaft contains a pair of notches 100. A solid twister shaft 102, having a bifurcated twister head 104 on one end, is slideably disposed within the hollow shaft 96 leaving the twister head 104 exposed beyond the frame 20. The solid twister shaft 102 also includes a thru-pin 106 that mates with the notches 100 in the hollow shaft, permitting rotation of both shafts when driven by the shaft gear 98 and, yet allows separate movement of the solid twister shaft when disengaged from the notches 100. A twister compression spring 108 is disposed over the solid twister shaft 102 on the end opposite the head 104 and held in place by a crescent retaining ring 110 embedded on one end and butts against the frame 20 on the other. This spring 108 spring loads the solid twister shaft 102 such that it may be extended on the open end by manually pushing the shaft forward, thereby exposing the head 104 in the product retaining throat 26 of the cam plate 22 for untangling tie material 76 that may be fouled around the head 104. The entire twister 94 is disposed rotatably within the frame 20 using shaft bushings 112 on each intersection to facilitate ease of rotation. The purpose of the twister 94 is to grasp and twist the tie material 76 with the head 104 when it is turned a predetermined number of rotations by the drive means.

A twister drive train 114 is rotatably disposed within the frame 20 and intermeshes with the bevel gear segment 84 on the gear cluster 74 on one end and the twister shaft gear 98 on the other for transmitting rotational energy from the gear cluster 74 to the twister 94. This drive train 114 is depicted by itself in FIG. 8 and consists of a twister gear shaft 116 having a first and second end. A twister bevel gear 118 is attached to the first end and a twister spur gear 120 on the second end. The bevel gear 118 interfaces with the gear segment 84 a sufficient amount of time to rotate the twister shaft gear 98 the predetermined number of turns. A capstan 122 is positioned between the above mentioned gears and includes a plurality of outwardly depending spokes 124, preferably four. These spokes 124 penetrate into a hole in the capstan latch plate 36, stopping the rotation of the gear shaft 116 at the precise location for optimum positioning of the twister head 104 such that the forks of the head will grab the tie material 76 properly when the twist cycle begins. Alternating grooves may be substituted opposite a tine on a spring.

Figure 9:
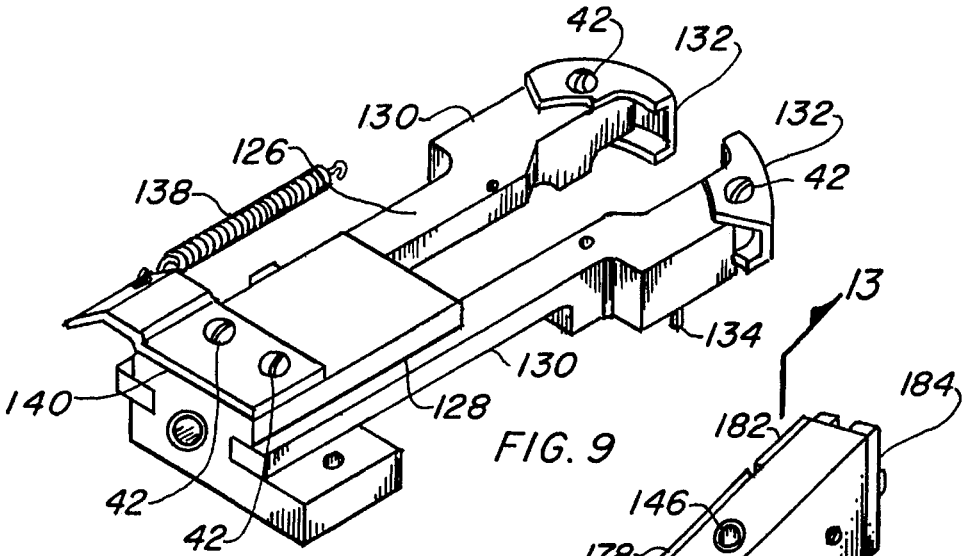
FIG. 9 is a partial isometric view of the shuttling carriage completely removed from the invention for clarity.

Encircling and tightening means surround the tie material 76 on the product and urge the tie material into tight intimate contact therewith. FIG. 9 depicts a spring loaded shuttling carriage 126 that accomplishes this functional operation. This carriage 126 includes a carriage block 128 that slides back and forth on the hollow shaft 96 of the twister 94 that is captivated within the frame 20. A pair of opposed swinging arms 130 are pivotally attached to the carriage block 128 with threaded fasteners 42. Each arm 130 includes a pivotal gate 132 located on an end opposite the block connection using a similar attachment method. These gates 132 are slightly separated from the arms 130 and are curved on the inside providing an arcuate guide path for the tie material 76 that penetrates the cavity therebetween. The gates 132 are positioned to allow the tie material to penetrate the first gate and following the contour of the cavity, continue unsupported across the gap between the gates and maintain course completely through the second gate 132, thereby surrounding the product on three sides. Each arm 130 also contains a guide pin 134 that protrudes from the bottom of the arm and penetrates the opposed recessed grooves 24 in the cam plate 22. These grooves' 24 provide a guide path to separate the arms 130 to articulate the jaws while passing around the product to be tied and, when returned, pull the tie material 76 tightly into the product along the same path allowing completion of the operation.

Figure 3:
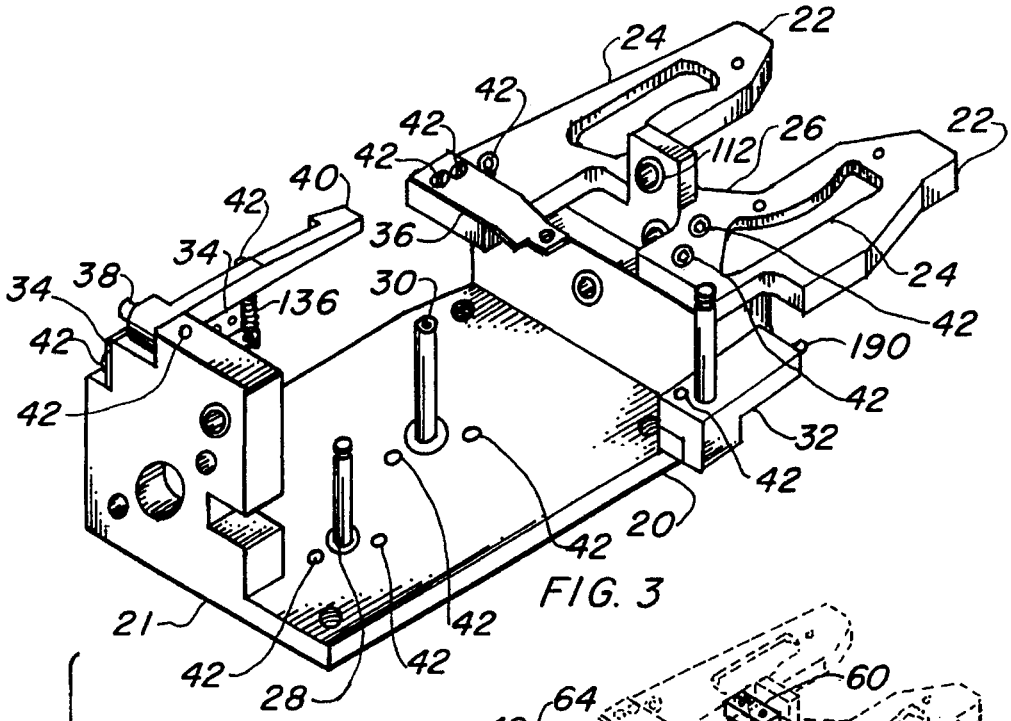
FIG. 3 is a partial isometric view of only the mounting frame and permanently attached structural components, shown separate from the invention.

The carriage 126 is locked in place in the retracted position by the carriage latch 40 that is spring loaded with a latch spring 136 connected between the latch 40 and the roller switch mounting plate 34, depicted in FIG. 3. As the turntable 88 rotates, the upstanding pin 90 impinges on the bottom surface of the latch 40 lifting it upward, separating it from an extended arm of the carriage block 128. This action permits the carriage 126 to shuttle toward the product under the influence of an extension carriage spring 130 that is connected between the cam plate 22 and a return spring bracket 140 mounted on the carriage block 128, best illustrated in FIG. 2. When the tie material 76 is fed into the gates 132 and cut at a predetermined length, the upstanding pin 90 interfaces with an angular protrusion on the bottom of the block 128 camming the shuttling carriage 126 away from the product until it is again held captive by the latch 40. It should be noted that the tie material length is determined by the cam plate 22 which is matched to the appropriate pre-set diameter of the product, and by the requirement that the tie comes to rest in a position which is symmetrically located about the centerline of the throat 26. When the product is held tightly against the throat 26 of the cam plate 22, the twister head 104 grasps the tie material 76 and completes the tying operation.

The feeding, measuring, and cutting means consists of a feed transport arm 142, including rollers and cutters, with the arm attached arcably to the frame 20. The arm 142 is a composite of a number of elements integral thereunto. The basic structure is an arm member 144 that is elongated and bent angularly near the middle, as illustrated in FIGS. 10 through 13. The arm member 144 has a sleeved bore 146 therethrough near one end, permitting mounting on the pivot block arm 32, shown in FIG. 3. The position of the block 32 places the. arm member 144 near the gear cluster 74 when installed thereon for positioning and driving the feed transport arm 142. An inwardly extending knuckle 148, with a hole therethrough integral with the member 144, provides an opening to receive a drive gear shaft 150 upon which a knurled roller 152 is attached on the top and a feed drive spur gear 154, along with a cam follower, is attached at the bottom. A compliance arm 158, shown removed from the invention in FIG. 14, is pivotally mounted as an appendage to the arm member 144 with a compliance arm shaft 160. The compliance arm 158 has a radial end with a hole therein and the arm member contains a hollowed window 162 through which the arm 158 extends and the shaft 160 penetrates therethrough forming the pivotal connection. The compliance arm 158 has a cylindrical portion with a bore therethrough into which a one-way roller clutch 164 is pressed on the bottom and a driven shaft bearing 166 on the top. The roller clutch 164 acts as a tactile feed-back to the operator indicating the proper direction of rotation during the loading sequence. A compliance arm driven shaft 168 is positioned through the bearing 166 and clutch 164, and mounts an idler roller 170 on the top and a thumbwheel 172 on the bottom end. The idler roller 170 is preferably formed of a metallic sleeve with an elastomeric polyurethane band thereabout. The compliance arm 158 is spring loaded to the arm member 144 with a threaded fastener 42 in the form of a screw with an arm compression spring 174. The spring tension holds the idler roller 170 in intimate contact with the knurled roller 152 tightly grasping the tie material 76 when it passes therebetween. The thumbwheel 172 permits loading of the tie material through the feed transport arm 142 by manually rotating it during the initial start up of the apparatus.

Figure 10:
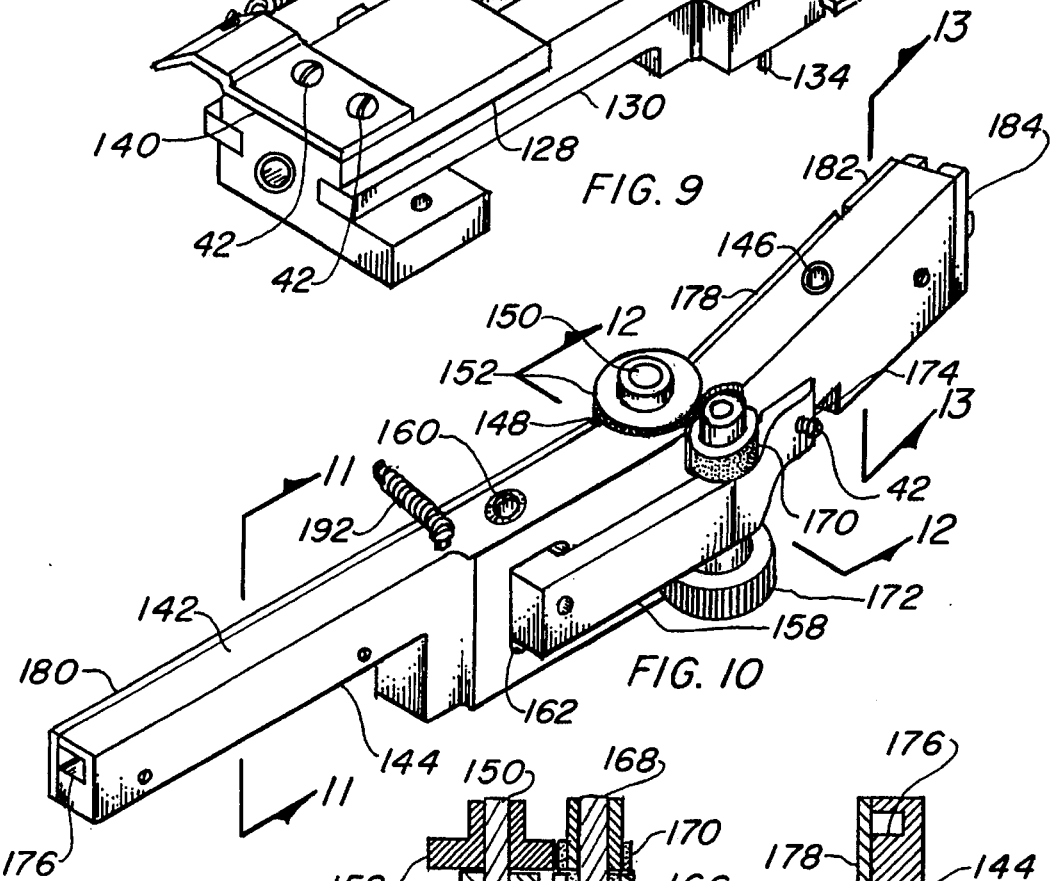
FIG. 10 is a partial isometric view of the feed transport arm completely removed from the invention for clarity.
Figure 11:
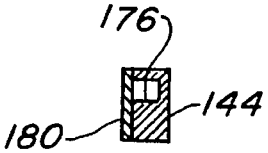
FIG. 11 is a cross-sectional view taken along lines 11—11 of FIG. 10.
Figure 12:
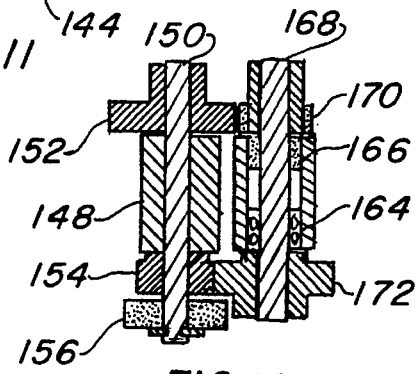
FIG. 12 is a cross-sectional view taken along lines 12—12 of FIG. 10 illustrating the rollers.
Figure 13:
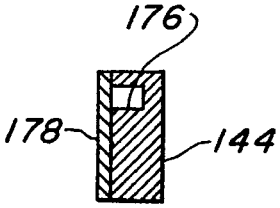
FIG. 13 is a cross-sectional view taken along lines 13—13 of FIG. 10.
Figure 14:
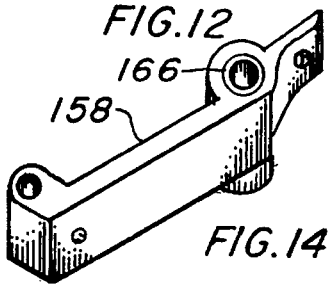
FIG. 14 is a partial isometric view of the compliance arm completely removed from the invention for clarity.
Figure 15:
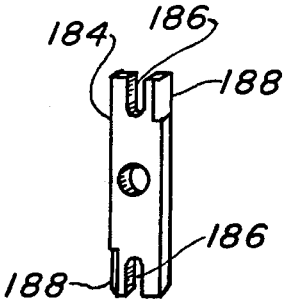
FIG. 15 is a view of the rotating cutting blade completely removed from the invention for clarity.
Figure 16:
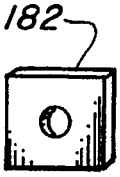
FIG. 16 is a view of the stationary cutter completely removed from the invention for clarity.

The arm member 144 contains a material feed recess 176, best shown in FIGS. 11 and 13. The recess 176 is enclosed by a short side plate 178 in the operating end and a long side plate 180 on the feed end. The recess 176 continues through the entire length of the arm member 144, except where the idler roller 170 and knurled roller 152 intersect. The short side plate 178 does not cover the entire area as a stationary cutter 182, depicted singly in FIG. 15, covers the remaining portion. This cutter 182 is square with all four sides ground flat to create sharp cutting edges. This shape permits rotating to a fresh cutting surface when it is dulled by wear and may even be turned over for another set of sharp edges. A rotating cutting blade 184, illustrated by itself in FIG. 16 and assembled in FIG. 10, is attached to the end of the arm member 144 at right angles to the stationary cutter. The blade 184 contains a notch 186 and four beveled cutting edges 188. The notch 186 interfaces with a pivot pin 190 in the pivot block arm 32. When the feed transport arm 142 pivots outwardly away from the gear cluster 74, the blade 184 rotates across the open end of the recess 176. During operation the recess 176 contains the tie material 76, therefore, compressing the material between the beveled cutting edge 188 of the cutting blade 184 and the ground cutting edge of the stationary cutter 182 severing the tie material. It will be noted that the cutting blade embodiment contains notches 186 and cutting edges 188 on both ends, permitting 180 degree rotation of the blade when it becomes worn, which presents two more cutting edges when turned over.

The feed transport arm 142 is urged inwardly toward the gear cluster 74 by an arm extension spring 192. In operation the tie material 76 is initially fed into the material feed recess 176 and urged forward by manually rotating the thumbwheel 172. When the gear cluster 74 is rotated the feed transport arm cam 78, located on the bottom of the gear cluster, permits the feed drive spur gear 154 to intermesh with the drive spur gear 80 rotating the knurled roller 152 through the drive gear shaft 150 to pinch against the idler roller 170, urging the tie material 76 forward the appropriate distance. The feed transport arm cam 76 then engages the cam follower 156 pushing the spur gear 154 from contact with the drive spur gear 80 and into tension by the arm extension spring 192, ready for the next operational cycle. At the same time, the pivoting of the feed transport arm 142 cuts the tie material 76, as previously described. It will be noted that the pivot block arm 32 may be positioned in any of three sets of holes in the frame 20. The position of the block relative to the cam plate 22 determines the length of the cut tie material 76 when the entire feed transport arm 142 is relocated. The three positions relate to the nominal 3/8, 3/4 or 1 inch (0.95, 1.90 or 257 cm) diameter.

Figure 17:
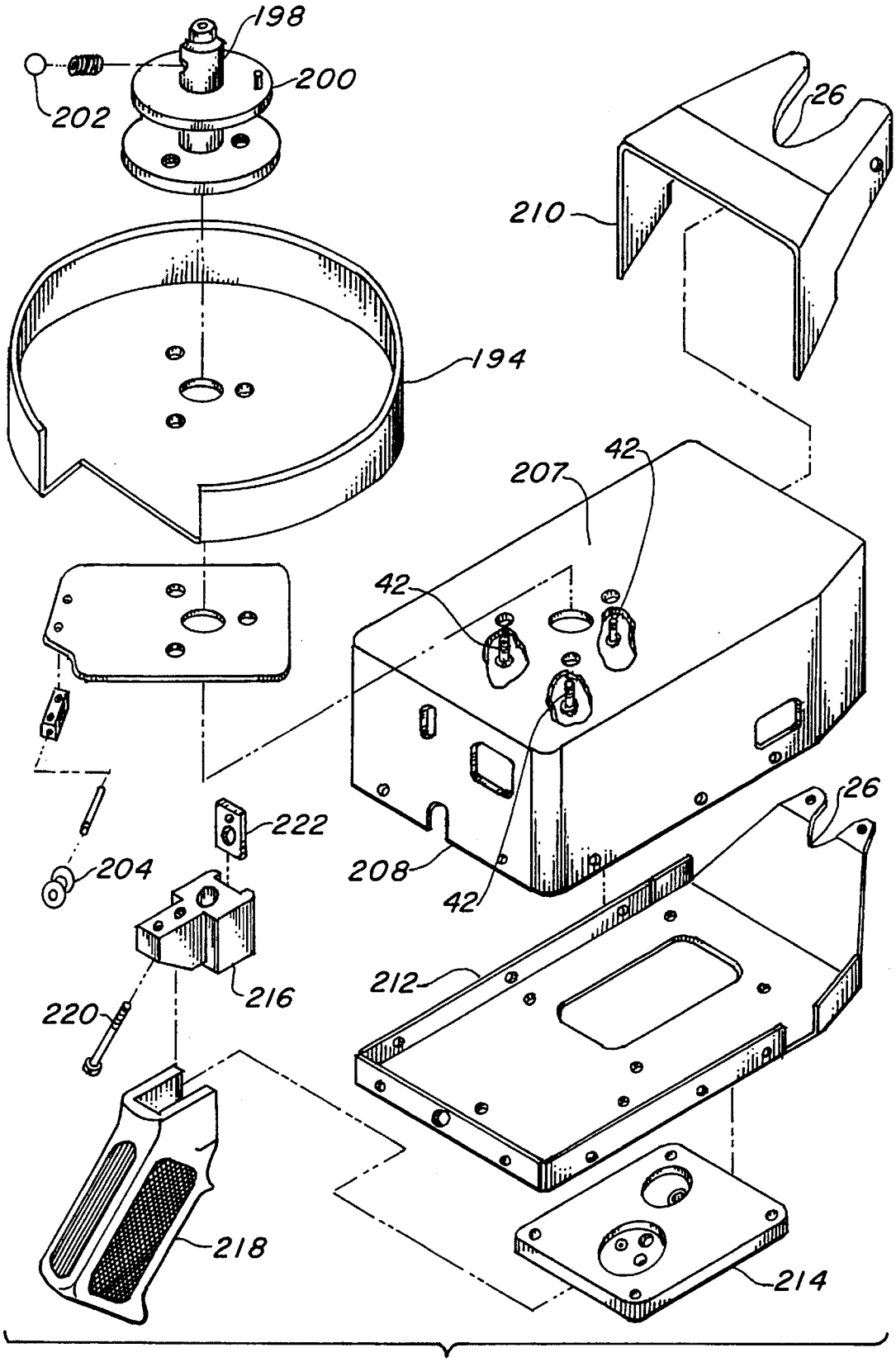
FIG. 17 is an exploded view of the enclosure completely removed from the invention for clarity.

The twist tie storage and supply means is depicted in FIG. 17 and accommodates a roll of twist tie material 78 while also integrally enclosing the operating mechanism of the apparatus. A reel holder 194 is disposed on top of the apparatus, as depicted in FIG. 1, and consists of a reel guard 196, slightly larger in diameter than a roll of twist tie material 76. The holder 194 is in an open dish shape, except for access cut-outs that expose the material and allow handling of the roll. A flanged reel spindle 198 is located on top of the guard 196, held together with threaded fasteners 42 from beneath. The spindle 198 supports a flanged bearing 200 with an upstanding pin that penetrates one of the alignment holes within a tie material roll. The roll fits over the vertical shaft of the spindle 198 and is held in place with a ball lock 202 consisting of a spring loaded ball in a bore within the spindle shaft retained by a sleeve.

A turn around roller 204 is mounted on a roller plate 206 disposed beneath the reel guard 196 and directs the tie material 76 from the roll into the feed transport arm 142, turning around 180 degrees in the process.

An enclosure 207 encompasses the moving parts of the apparatus for safety protection. A housing 208 is attached to the spindle 198 using threaded fasteners 42, previously described, with the roller plate 206 and reel guard 196 sandwiched therebetween. The housing 208 has cut-outs for the input power connection cable 56, the feed transport arm 142, the solid twister shaft 102, and the thumbwheel 172, all of which are necessary for access during operation. A cam plate shield 210 is pivotally mounted onto the cam plate 22 and also covers the forward end of the twister 94 and shuttling carriage 126. This shield 210 includes a cut-out for the product receiving throat 26 and is pivotally hinged to the cam plate 22 on the outward end, permitting access to the twister head 104 when it is slid outwardly by depressing the solid twister shaft 102 for clearing tangles on the head. The housing 208 and shield 210 may be of any material suitable for the application, however, vacuum formed thermoplastic, such as polyethylenes, polypropylenes, or polystyrenes, with acrylonite butadeine styrene (ABS) being preferred.

The enclosure 207 is removably attached to a bottom plate 212 which forms a structural part of the frame 20. The attachment is preferably made with threaded fasteners 42 permitting the assembly and disassembly to be easy and repeatable. An adapter plate 214 is connected to the structural base 21 through the bottom plate 212 providing attachment for adapter means in the form of a handle adapter 216. A handle 218 is positioned over the adapter 216 and a through bolt 220 holds the handle 218 securely in place. The trigger switch 62 is mounted with a lock ring onto a switch plate 222 and inserted into a cavity in the grip adapter 216 with wires leading to the electronic switch module 66.

In operation, a roll of twist tie material 76 is placed on the reel spindle 198 and the end of the material 76 is looped over the turn around roller 204 and threaded into the recess 176 in the feed transport arm 142. The thumbwheel 172 is rotated by hand until the tie material is stopped by the closed cutting blade 184.

The apparatus is held by hand and power is connected by plugging in the cable 56 from the battery 48 located in the holder 50 and the accompanying belt 52 placed around the operators waist. Alternately, power may be provided by the power converter 58 located remotely.

In either event, the apparatus is carried to the product to be secured and positioned such that it impinges against the product present switch 60. The trigger switch 62 is depressed and power is supplied to the motor 44. The motor 44 rotates the gear cluster with turntable 74 and the upstanding pin 90 on the turntable 88 intersects the carriage latch 40, lifting it upwards until it trips, allowing the shuttling carriage 126 to slide forward under the influence of the carriage spring 138.

The gear cluster 74 continues to rotate and the cam follower 156 drops off of a lobe on the feed transport arm cam 78, permitting the entire spring loaded feed transport arm 142 to pivot into the gear cluster 74. The feed drive spur gear 154 is then engaged with the main drive spur gear 80. This action rotates the knurled roller 152 pinching the tie material 76 between it and the idler roller 170, advancing it forward the exact length in the material feed recess 176 and through the, then extended, pivotal gates 132 on the ends of the swinging arms 130. The material 76 bridges the gap and is positioned around the product that is located in cam plate throat 26.

The cam follower 156 is then moved away by the lobe on the feed transport arm cam, pivoting the feed transport arm 142 away from the gear cluster 74 disengaging the drive spur gear 154 and stopping the movement of the tie material 76. The same pivoting movement of the arm 142 causes the cutting blade 184 to rotate against the stationary cutter 182 severing the tie material 76.

The upstanding pin 90 on the turntable 88 engages an angular protrusion on the bottom of the carriage block 128 and forces the shuttling carriage 126 back against spring tension until the carriage latch 40 catches the carriage block 128. The shuttling movement of the carriage 126 draws the tie material back with it beyond the cam plate throat 26, as the arms 130 swing outwardly and back inwardly, as it circumvents the product. Coming to a stop aft of the twister tines, the tie material is now held taut against the product with the ends formed parallel with the mechanical centerline and well behind the tines.

As the gear cluster and turntable 74 continue to rotate, the bevel gear segment 84 comes in contact with the bevel gear 118 of the twister gear train 114 rotating the twister 94. As the bifurcated twister head 104 rotates, its tines engage both ends of the precut tie material 76 and twist them together, preferably two and one-half turns.

At the completion of the twisting procedure the capstan latch plate 36 drops onto one of the spokes 124 on the capstan 122 or grooves opposite a tine on a spring, as the turntable 88 contains a cam cut-out 92 on the peripheral top surface. This action locks the twister head 104 in the proper vertical alignment to grasp the tie material 76 on the next sequence of operation.

The termination of one complete rotation of the gear cluster with turntable 74 is accomplished when a roller switch stop 82, located on the drive spur gear 80, trips the roller switch 64, deenergizing the latching relay of the electronic switch module 66.

While the preferred embodiment has been described in complete detail and pictorially shown in the accompanying drawings and block diagram, the invention is not to be restricted to such details and limitations since many simplifications, cost improvements, element changes, and modifications may be made in the invention without departing from the spirit and scope thereof. Hence, it is described to cover any and all modifications and forms which may come within the language and scope of the appended claims.

What is claimed is:

1. A hand held twist tie apparatus for securing products with twist tie material comprising;

electromechanical mounting and single, rotating drive means for, mounting, powering, controlling, and activating the apparatus, twisting means, contiguously energized by said drive means for twisting the tie material into a tight joint, nonrotational encircling and tightening means attachably shuttled onto said twisting means surrounding the tie material on the product and urging the tie material into intimate contact thereupon, feeding, measuring and cutting means contiguously set in motion by said drive means, directing a predetermined amount of tie material into said encircling and tightening means and cutting to length therewith, and twist tie material storage and supply means juxtapositioned on said drive and mounting means accommodating a roll of tie material and introducing a free end of the material into said feeding, measuring, and cutting means for securement of a product with a length of tightly twisted tie material.

2. The twist tie apparatus as recited in claim 1 wherein said electromechanical mounting drive means further comprise;

a mounting frame having an outwardly extending cam plate with a product receiving throat therein, an electric drive motor, having a shaft drive gear, attached to said frame, for supplying electromotive force to operate the apparatus, motor control switch means, electrically communicated with the motor, providing electrical power, starting and stopping the motor at a precise time interval, reduction drive gears revolvably affixed to said frame rotatably driven by said shaft drive gear, for decreasing the rotational speed of the motor, and a gear cluster with turntable revolvably affixed to said frame, rotatably driven by said reduction drive gears to provide energy to said twisting, encircling, tightening, feeding, measuring, and cutting means.

3. The twist tie apparatus as recited in claim 1 wherein said encircling and tightening means further comprise a spring loaded shuttling carriage slideably attached to said twisting means and in communication with said drive means, when the drive means are energized the carriage is released shuttling along the twisting means, camming outwardly around the product, receiving two ends of cut tie material across a symmetrical open gap and cammed back to surround the product with tie material, permitting the twisting means to secure the material therearound.

4. The twist tie apparatus as recited in claim 1 wherein said feeding, measuring, and cutting means further comprise a feed transport arm having rollers and cutters, attached adjacent to said encircling and tightening means, the rollers are rotated a predetermined number of revolutions by the drive means advancing the tie material, pinched between the rollers, into the encircling and tightening means, further severing a continuous end of the tie material with the cutters at an appropriate time interval.

5. The twist tie apparatus as recited in claim 1 wherein said twist tie material storage and supply means further comprise a reel holder having a turn around roller integral therewith said holder is disposed on top of the apparatus and stores a reel of tie material and provides a roller to change direction of the material for introduction into the feeding, measuring, and cutting means.

6. A hand held twist tie apparatus for securing products with twist tie material comprising;

electromechanical mounting and drive means for, mounting, powering, controlling, and activating the apparatus, twisting means, contiguously energized by said drive means for twisting the tie material into a tight joint, said twisting means further comprise a set of combined hollow and solid shafts having a shaft gear thereon, said shafts having a bifurcated twister head disposed thereon with both shafts positioned adjacent to and simultaneously rotated by said drive means, with the twister head grasping and twisting the tie material when rotated a predetermined number of rotations by the drive means, encircling and tightening means attachably shuttled onto said twisting means surrounding the tie material on the product and urging the tie material into intimate contact thereupon, feeding, measuring and cutting means contiguously set in motion by said drive means, directing a predetermined amount of tie material into said encircling and tightening means and cutting to length therewith, and twist tie material storage and supply means juxtapositioned on said drive and mounting means accommodating a roll of tie material and introducing a free end of the material into said feeding, measuring, and cutting means for securement of a product with a length of tightly twisted tie material.

7. A hand held twist tie apparatus for securing products with twist tie material comprising;

a) a mounting frame including an outwardly extending cam plate having opposed recessed grooves, also a product receiving throat, b) a drive motor having a shaft gear and motor control means mounted on said frame to supply electromotive force to operate the apparatus and control for the functional operation thereof, c) reduction drive gears revolvably affixed to said frame rotatably driven by said drive motor shaft gear for decreasing the motor output speed, d) a gear cluster and turntable revolvably affixed to said frame and rotatably driven by said reduction drive gears for providing rotational force and torque to the apparatus, e) a twister having a hollow shaft with a shaft gear thereon, a spring loaded solid twister shaft having a bifurcated twister head on one end with the solid shaft disposed within the hollow shaft, both rotatably connected on each end to the frame directly above the gear cluster with turntable also driven thereby, with the twister head grasping and twisting the tie material when rotated a predetermined number of rotations, f) a twister drive train rotatably disposed within the frame contiguous with the gear cluster and twister gear for transmitting rotation energy from the gear cluster directly to the twister, g) a spring loaded shuttling carriage slideably attached over the twister hollow shaft in communication with the turntable, when the carriage is released by rotation of the turntable, the carriage shuttles along the hollow shaft camming outwardly, as guided by the recessed grooves in the frame cam plate, around the product receiving a predetermined length of cut tie material across an open gap and camming back to surround and hold the product with tie material when the turntable completes a revolution, permitting the twister head to grasp the tie material and twist it therearound, h) a feed transport arm having rollers and cutters attached arcably to the frame, the rollers are rotated a predetermined number of revolutions by the gear cluster, advancing the tie material pinched between rollers into the shuttling carriage, also severing a continuous end of the tie material with the cutters at an appropriate time interval triggered by a cam on the gear cluster, and i) an enclosure having a handle and a reel holder, said handle connected to the frame structure for gripping said enclosure, encompassing said apparatus for protection from moving parts, said reel holder having a rotatable reel spindle and turn around roller integral therewith, mounted on top of the enclosure for storing a reel of tie material and providing a roller to change direction of the material for introduction into the feed transport arm.

8. The twist tie apparatus as recited in claim 7 wherein said frame further comprises a structural base with a reduction gear post joined to the base, a cluster gear post joined to the base, and a feed transport pivot block arm joined to the base for rotatable attachment of respective elements thereupon.

9. The twist tie apparatus as recited in claim 7 wherein said motor is powered by electric direct current having a potential of from 9 volts to 14 volts, and said motor control means further comprise a remote battery, a connection cap with cable for supplying power to the motor, a product present switch, a trigger switch, and a roller switch, positioned within the apparatus for controlling power to the motor, and an electronic switch module attached to the frame having an electromagnetic latching relay, said control means maintaining power to the motor for an interval of time equating to one complete revolution of the gear cluster and turntable per operational incident.

10. The twist tie apparatus as recited in claim 7 wherein said motor is powered by electric direct current having a potential of from 9 volts to 14 volts, and said motor control means further comprising, a remote alternating current power to direct current power converter with cable for supply power to the motor, a product present switch, a trigger switch, and a roller switch, positioned within the apparatus for controlling power to the motor, and an electronic switch module attached to the frame having an electromagnetic latching relay, said control means maintaining power to the motor for an interval of time equating to one complete revolution of the gear cluster and turntable per operational incident.

11. The twist tie apparatus as recited in claim 7 wherein said reduction drive gears further comprise a motor worm gear joined unitedly with a cluster spur gear, both rotatably mounted on said frame.

12. The twist tie apparatus as recited in claim 7 wherein said gear cluster with turntable further comprises;

a feed transport arm cam on the gear cluster bottom for triggering the feed transport arm into communication with the gear cluster, a drive spur gear mounted on top of the feed transport arm cam in driven communication with said reduction drive gears for rotational actuation and transmitting rotational energy to the feed transport arm to advance the tie material pinched between the rollers, a roller switch trip attached on a top surface of the drive spur gear to trip said motor control means when the drive spur gear rotates to a given position, a bevel gear segment disposed on top of the drive spur gear to rotate said twister drive train at the appropriate sequence in the gear cluster's rotation, a stand-off cartridge positioned on top of the bevel gear segment for spacing the gear cluster relative to its activation function, and a turntable, having an upstanding pin and cam cut-out on a top surface thereof, the turntable mounted directly on top of the stand-off cartridge, the turntable pin triggers release of said shuttling carriage and returns the carriage to its spring loaded position on each rotation of the turntable, the cam cut-out interfaces with the twister drive train to orient the twister head to the functional position.

13. The twist tie apparatus as recited in claim 7 wherein said twister further comprises a twister compression spring disposed over said solid twister shaft, and a crescent retaining ring embedded into the shaft in intimate contact with the spring for spring loading the solid twister shaft, and said hollow shaft having a pair of notches on one end with said solid twister shaft having a thru-pin interfacing with said shaft notches, such that the solid twister shaft may be manually depressed against urging of the compression spring to expose the twister head within the mounting frame product receiving throat for untangling tie material fouled around the twister head.

14. The twist tie apparatus as recited in claim 7 wherein said twister drive train further comprises a gear shaft having a first and a second end rotatably attached to the mounting frame, a twister bevel gear attached to the first end of the shaft driven by said gear cluster, a twister spur gear on the second end of the shaft transmitting rotational power to the twister, and a capstan on the shaft in between the gears interfacing with a latch plate on the mounting frame to stop rotation of the twister drive train at an exact location for optimum positioning of the twister head.

15. The twist tie apparatus as recited in claim 7 wherein said shuttling carriage further comprises a carriage block interfacing slideably with said twister hollow shaft, a pair of opposed swinging arms pivotally attached to the carriage block, each having a pivotal gate on an end opposite the block attachment and a guide pin, with the guide pins communicating with the recessed grooves in said cam plate to complete product securing.

16. The twist tie apparatus as recited in claim 7 wherein said feed transport arm further comprises a thumbwheel attached to said rollers for manually feeding the tie material into the apparatus, a one-way roller clutch integral with the rollers for producing back feeding of the tie material, and a compliance arm under spring pressure to force the rollers together to grasp and transport the tie material through the arm.

17. The twist tie apparatus as recited in claim 7 wherein said enclosure further comprises a bottom plate connected to said mounting frame, a housing connected to said bottom plate for enclosure therewith, said handle having adapter means connected to said bottom plate and said handle attached thereunto, said reel holder having a reel spindle connected to the housing and said reel spindle having a bearing and ball lock to contain and hold a roll of tie material.

* * * * *